United States Patent [19]

Muller

[11] Patent Number: 4,799,279

[45] Date of Patent: Jan. 24, 1989

[54] METHOD OF CONSTRUCTING THE APPROACH AND MAIN SPANS OF A CABLE STAYED SEGMENTAL BRIDGE

[75] Inventor: Jean M. Muller, Tallahassee, Fla.

[73] Assignee: Figg and Muller Engineers, Inc., Tallahassee, Fla.

[21] Appl. No.: 102,318

[22] Filed: Sep. 25, 1987

Related U.S. Application Data

[63] Continuation of Ser. No. 803,669, Dec. 2, 1985, abandoned.

[51] Int. Cl.[4] ..... E01D 21/04

[52] U.S. Cl. ..... 14/1; 14/18; 14/77

[58] Field of Search ..... 14/1, 18, 23, 75, 77; 52/745

[56] References Cited

U.S. PATENT DOCUMENTS

| | | | |
|---|---|---|---|
| 3,299,191 | 1/1967 | Mantscheff et al. | 264/34 |
| 3,382,680 | 5/1968 | Takano | 52/223 R X |
| 3,448,511 | 6/1969 | Suter | 14/1 |
| 3,571,835 | 3/1971 | Büchler | 14/1 |
| 3,832,748 | 9/1974 | Ogletree | 14/1 |
| 3,882,564 | 5/1975 | Muller | 14/77 |
| 3,902,212 | 9/1975 | Muller | 14/1 |
| 3,937,165 | 2/1976 | Thivans | 14/77 |
| 3,975,476 | 8/1976 | Finsterwalder | 14/23 X |
| 3,989,218 | 11/1976 | Muller | 14/1 |
| 4,087,220 | 5/1978 | Koss | 14/1 |
| 4,103,861 | 8/1978 | Büchler et al. | 14/1 |
| 4,319,374 | 3/1982 | Schambeck | 14/1 |
| 4,352,220 | 10/1982 | Wittfoht | 14/1 |
| 4,513,465 | 4/1985 | Schambeck | 14/18 X |

FOREIGN PATENT DOCUMENTS

| | | | |
|---|---|---|---|
| 1235973 | 3/1967 | Fed. Rep. of Germany | 14/18 |
| 2361182 | 6/1974 | Fed. Rep. of Germany | 14/1 |
| 339135 | 4/1936 | Italy | 14/13 |
| 357317 | 12/1972 | U.S.S.R. | 14/77 |
| 1092355 | 11/1967 | United Kingdom | 14/1 |
| 1210680 | 10/1970 | United Kingdom | 14/13 |

OTHER PUBLICATIONS

The Construction Specifier, Apr. 1980.

*Primary Examiner*—Jerome W. Massie
*Assistant Examiner*—Matthew Smith
*Attorney, Agent, or Firm*—Watson, Cole, Grindle & Watson

[57] ABSTRACT

A method of constructing the approach and main spans of a cable stayed segmental bridge as the main span is constructed as a smooth continuation of the approach spans without the need for special equipment or different box girder deck sections. The approach spans are constructed each in succession from opposite sides of the main span after which the main span continues from opposite sides toward a midpoint, while the cable stays are installed. For a two-wide box girder bridge, delta frames interconnect side-by-side box girders at the anchor locations of the cable stays for thereby transferring the static and dynamic loads of the main span toward the center plane of support of the cable stays.

9 Claims, 4 Drawing Sheets

20
21
22
23
24
25
25a
25b
25c
25d
25e
26
27
28
29
31
32

METHOD OF CONSTRUCTING THE APPROACH AND MAIN SPANS OF A CABLE STAYED SEGMENTAL BRIDGE

This application is a continuation of application Ser. No. 803,669, filed Dec. 2, 1985, now abandoned.

BACKGROUND OF THE INVENTION

This invention relates generally to a bridge construction technique for a cable stayed segmental bridge in which modules in the form of precast concrete, hollow box girders are progressively placed and interconnected to form both a relatively long main bridge span as well as approach bridge spans at opposite ends of the main span which is constructed as a continuation of the approach spans utilizing essentially the same box girders and avoiding the need for specialized construction equipment.

Various methods have been employed in the past for constructing the relatively short approach spans and the relatively long main span or spans which normally require special equipment and various kinds of deck sections for these different spans. For segmental bridge construction from concrete box girders, the shorter approach spans are oftentimes constructed using a cantilever technique whereby the segments are cantilevered and interconnected, one to the other, in opposite directions starting from a given bridge pier. A disadvantage with such technique is that, not only are costly and heavy equipment required for the job, but instability during construction creates serious problems as care must be taken to avoid uneven loading of the bridge segments on opposite sides of the pier, torsional instability from gusting winds when erecting long cantilevered spans, etc. Also, the length of the main span over a large body of water or a ravine is limited by such a method which requires the costly installation of piers in the water body or deep ravine. Nevertheless, the cantilever method is useful over some of the other bridge construction approaches requiring heavy equipment floated on the water, which presents many other drawbacks in logistics and only adds to the time and cost involved in constructing the bridge.

Cable stayed segmental bridges of concrete box girders permit longer main spans but oftentimes require different deck sections and special bridge equipment compared to that employed for the approach spans. Besides, main deck suspension by cable stays successively connected to high bridge pylons required for the main span or spans, can be quite time consuming and costly, and two-wide box girder bridges may require twin pylons and associated cables thereby adding to the time and cost of construction.

SUMMARY OF THE INVENTION

It is therefore an object of the present invention to provide a method of constructing the approach and main spans of a cable stayed segmental bridge in a relatively simple and time saving yet highly efficient manner utilizing a technique in which the approach spans are erected from opposite sides of the main span followed by construction of the main span as deck segments are cantilevered one to the other from the main span pylons toward the midpoint between them. The approach spans are constructed using a pair of box girder support trusses which span the piers, each adjacent approach span being completed from the shore while progressing toward the main span, with the use of handling equipment such as a simple swivel crane which loads the deck segments on to the assembly trusses. When the main span pylons are reached, the main span is constructed by the progressive placement of the deck segments utilizing the same or similar swivel crane, while the main span deck is supported by cable stays from the pylons.

Another object of this invention is to provide such a method wherein a two-wide box girder bridge is capable of being constructed for the approach spans and the main span as a continuation thereof with the provision of transverse load carrying members such as delta frames connecting the box girder pairs at which the girders are anchored to the cable stays, to thereby transfer static and dynamic loads to the central plane of support provided by the cable stays.

A further object of the present invention is to provide such method wherein the bridge pylons are erected from segments when assembling the cable stays to the main deck, such that a cable stay is draped over the top of a first of such segments, after which a second pylon segment is placed over the draped cable, and so on until the segmented pylon is completed.

Other objects, advantages and novel features of the invention will become more apparent from the following detailed description of the invention when taken in conjunction with the accompanying drawings.

DETAILED DESCRIPTION OF THE INVENTION

Figures 1, 2, 3, 4:
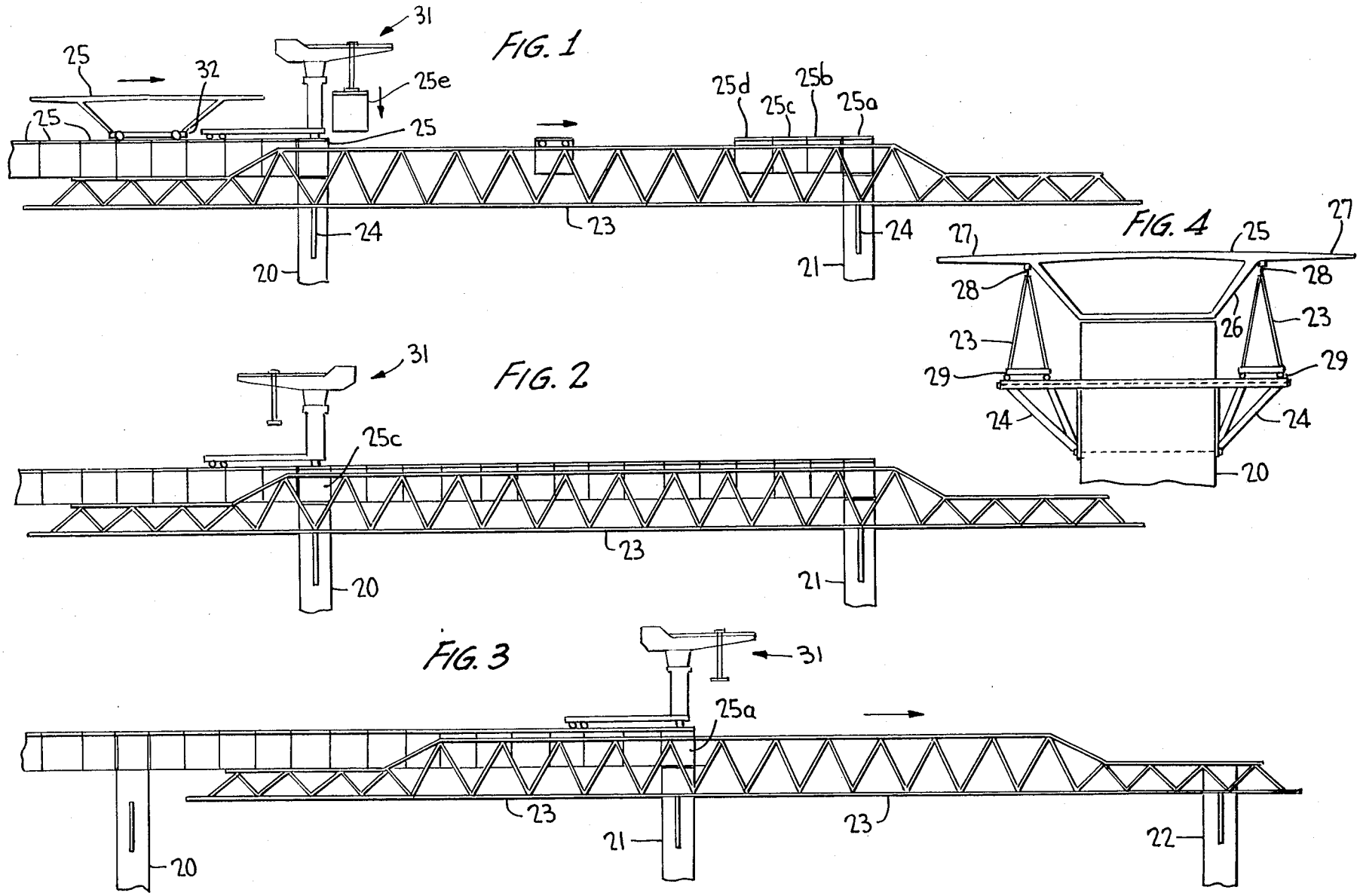
FIGS. 1, 2 and 3 are side elevational views showing the method of constructing the approach spans of a segmental concrete box girder bridge, according to the invention.
FIG. 4 is an end view of a pair of trusses on which the box girders are supported during the assembly process of FIGS. 1–3.
Figure 5:
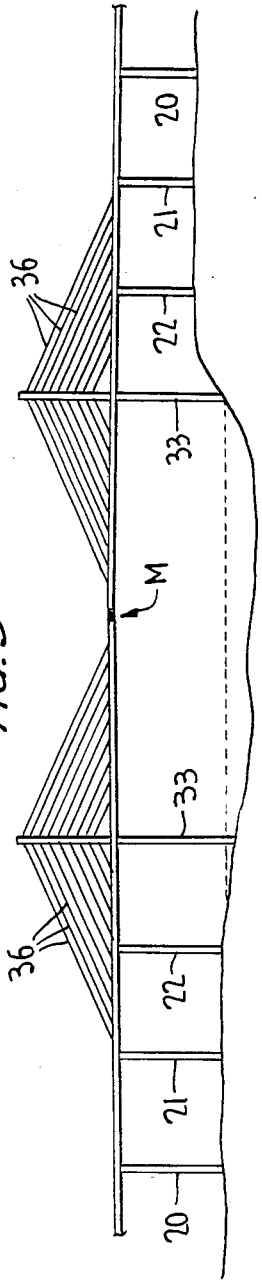
FIG. 5 is schematic illustration of a completed bridge constructed according to the invention.

Turning now to the drawings wherein like reference characters refer to like and corresponding parts throughout the several views, FIGS. 1–3 are side elevational views of the simple equipment used in successively constructing the approach spans of a segmental bridge, the approach spans being defined by spaced, concrete piers 20, 21, 22 (see also FIG. 5). The approach span construction, to be described, is typical for all approach spans from opposite shorelines, or from opposite edges of a ravine, toward the main span pylons.

An assembly truss 23 forms one of a pair of support trusses which extend between adjacent piers 20 and 21, as supported by laterally extending brackets 24. The truss pair will have been moved to the FIG. 1 position from an approach span at the left of pier 20 after having already constructed that approach span from precast concrete box girders 25. Each such girder, shown at an enlarged scale in FIG. 4, comprises a central box section 26 having inwardly sloping sides, and oppositely extending wing sections 27. The trusses support the box girders under their wing sections as shown, and sliding and adjusting devices 28 are provided between the trusses and the wing sections to permit the box girders to be slid along the trusses. And, hydraulic, or the like, jacks 29 are provided between the brackets and the trusses to facilitate major vertical truss adjustments.

After completing the approach span up to pier 20, a swivel crane 31 is mounted on box girder 25 directly over pier 20, and the assembly truss pair is moved into its position shown in FIG. 1 spanning piers 20 and 21. Each box girder 25 is cast at some location away from the bridge site, is transported by rail or road, and hauled over the already constructed approach span or spans by means of a traveling dolly 32. When it reaches the swivel crane location, the crane is swiveled to the left picking up the box girder, and after swiveling back through 180°, lowers the box girder between the truss pair such that the wing sections rest on devices 28. Some means (not shown) is employed for sliding a first of the box girders **25*a* until it overlies pier 21, and is secured to the top of the pier in some normal manner, after which box girders 25*b*, 25*c*, 25*d*, 25*e*, etc. are progressively, and one-at-a-time, lifted by the swivel crane and loaded onto the assembly trusses such that each of the box girders are abutted end-to-end, are adjusted relative to one another, and interconnected to each other, until the box girders completely fill the span between piers 20 and 21, as shown in FIG. 2. It can be seen that construction of the segmental span is carried out from pier 21 (which lies closer to the main span as compared to the distance of pier 20 therefrom) toward pier 20**, such that the box girders may be conveniently loaded by the swivel crane without interruption or interference.

After the approach span between piers 20 and 21 is completed, as in FIG. 2, trusses 23 are moved, to the right in FIG. 3, so as to extend between piers 21 and 22, swivel crane 21 is moved to overly pier 21, and the aforedescribed operation is repeated for constructing the segmental bridge deck between piers 21 and 22. Construction of the approach spans continues from opposite sides of the main span, toward bridge pylons 33 thereof (FIG. 5) until the main span is reached. It should be pointed out that the bridge trusses lying on opposite sides of the piers, and supporting the box girders under the wing sections thereof, are capable of supporting box girders, without interference, having central box sections of various depths depending on the structural requirements for the bridge.

Figure 6:
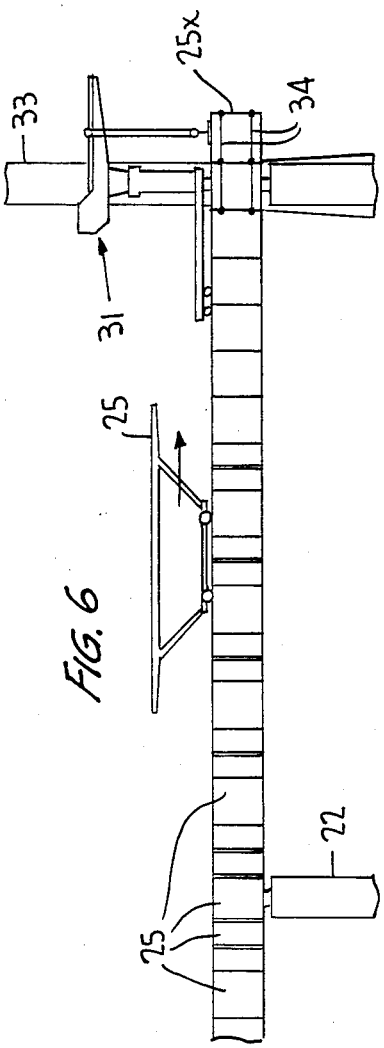
FIGS. 6 and 7 are side elevational views of the process employed in erecting the bridge main span according to the invention.
Figure 7:
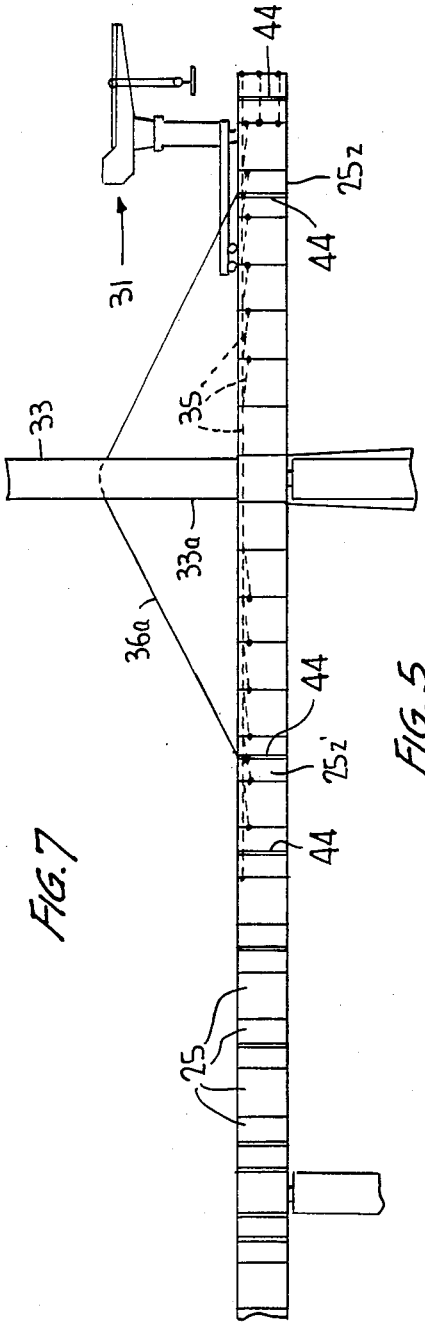

Turning to FIGS. 6 and 7, the last approach span from either side of the main span extends between the bridge pier 22 and bridge pylon 33, for example. The method of constructing the segmental bridge, as a continuation of the approach spans, is carried out by the provision of the same or similar swivel crane 33 which is now moved to the pylon station. Crane 31 picks up a box girder **25*x* from the dolly, is swiveled through 180°, and lowers the box girder until it cantilevers from an already constructed box girder at the pylon station, as shown in FIG. 6. This box girder 25*x* is held in place by temporary post tension bars 34, cantilever tendons 35, are installed, are stressed, a closure strip is poured between adjacent segments, transverse tendons (not shown) are stressed within the segments, and the operation is completed until a predetermined number of box girders are so assembled. At box girder 25*z*, for example, it will have been determined structurally that a cable stay 36 is now required for support of the main deck. The cable stay extends diagonally from both sides of the bridge pylon and is anchored to box girder 25*z* at the main span as well as to box girder 25*z*′ at the adjoining approach span. The swivel crane is progressively moved and places the box girders successively in cantilever fashion, as aforedescribed, until another predetermined box girder is reached at which another cable stay must be employed for supporting the main deck from the pylon. Another cable stay is therefore anchored to such designated box girder at the main span, and correspondingly at the adjoining approach span, until the midpoint M of the main span is reached (FIGS. 5 and 10**) with all the cable stays mounted in place. The confronting ends of the main deck sections, at midpoint M, are then joined together in some normal manner to provide a smooth continuation of the deck.

Figure 8:
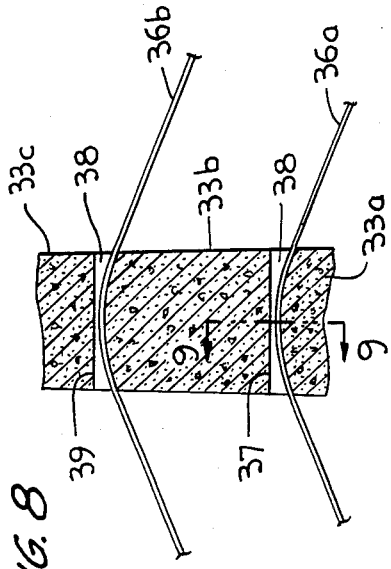
FIG. 8 is a detailed sectional view of the process of assembling a segmented pylon.
Figure 9:
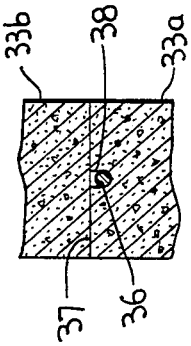
FIG. 9 is a sectional view taken substantially along the line 9—9 of FIG. 8.

During the process of constructing the main span, each bridge nylon 33 may be assembled in segments while cable stays 36 are being installed. Thus, the precast concrete pylon may be of limited height at the time it is anchored in place, so as to present a first pylon segment **33*a* with its upper end 37 exposed. FIGS. 7, 8, and 9 show the segmented pylon after completion, although it should be understood that first pylon segment 33*a* has its upper end 37 exposed at the time the first cable stay 36*a* is installed. And, a groove 38 is provided in upper end 37 of pylon segment 33*a* for the reception of cable stay 36*a* which is draped over the upper end of the first pylon segment so that its opposite ends may be anchored in place to box girders 24*z* and 25*z*′. Another pylon segment 33*b* is then placed over upper end 37, this pylon segment likewise having a groove 38 in its upper end 39. The next cable stay 36*b* is then draped over upper end 39 and is received within groove 38 after which the ends of the cable stay are anchored to selected ones of the box girders at the main span and at the last approach span adjoining the main span. As the main span construction progresses, the aforedescribed procedure is repeated such that further pylon segments are installed one on top of the other as further cable stays are draped over the respective upper ends thereof. Grooves 38** may thereafter by filled with a concrete grout, or the like, and the pylon segments are interconnected together in some manner.

Figure 10:
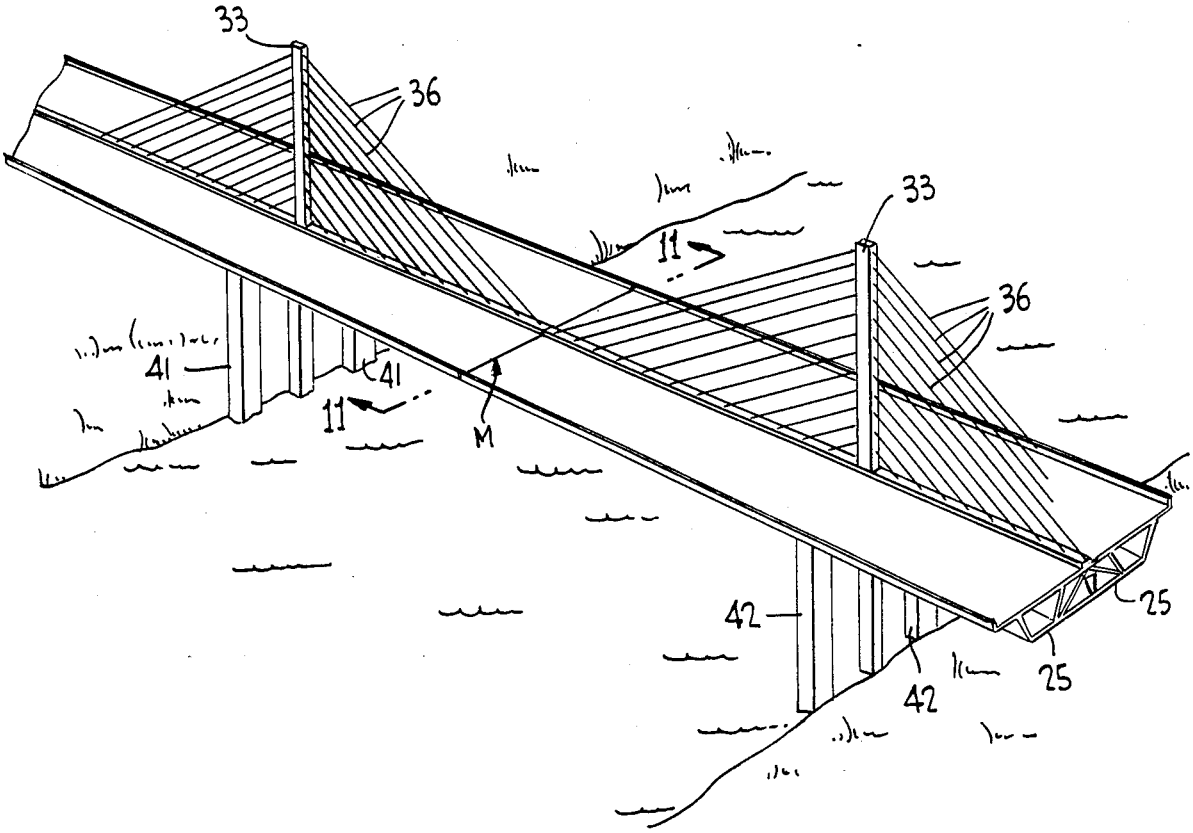
FIG. 10 is a perspective view of the main span and adjoining approach spans of a cable stayed box girder bridge according to the invention.
Figure 11:
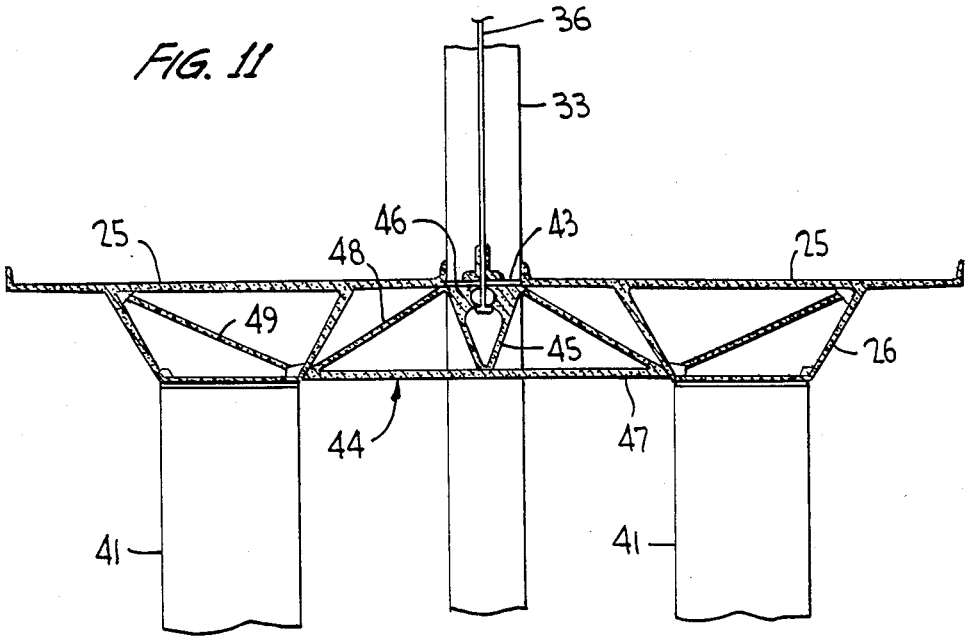
FIG. 11 is a sectional view of the twin box girders of FIG. 10 transversely interconnected.

The approach and main spans of a cable stayed segmental bridge may be constructed in accordance with the aforedescribed procedures as having two-wide precast concrete box girders 25, as shown in FIGS. 10 and 11. Thus, pairs of transversely spaced piers 20, 21, 22, etc. are provided for supporting the box girders side-by-side respectively on one of the pier pairs 20, 21, 22, etc. And, additional transversely spaced piers 41 and 42 are respectively provided transversely of the bridge pylons, as clearly shown in FIG. 10. During construction of the approach spans, two pairs of assembly trusses 23 are employed for spanning piers 20 and 21 and for supporting the box girders in the same manner as described with reference to FIGS. 1–4. The confronting wing sections 27 of each pair of box girders are simply interconnected by a concrete slab 43 or the like (FIG. 11) during the approach span construction.

And, the main span is constructed similarly as aforedescribed with reference to FIGS. 5–9, except that pairs of swivel cranes 31 may be employed as the main span deck sections are constructed toward the midpoint of the main span. And, delta frames 44, as typically shown in FIG. 11, interconnect each box girder pair at those designated locations at which the ends of the cable stays are anchored to the main span and the approach span deck sections. For example, when constructing a two-wide box girder bridge, the transverse delta frames 44 are provided at box girder pairs 25z and 25z', as shown in FIG. 7. The delta frames serve to transfer static and dynamic loads, at the connected box girder pairs, to the center plane of suspension at which the cable stays are located. In such manner, the two-wide box girder span may be constructed of box girder sections of less height and mass compared to that required for a single-wide box girder main span. Thus, less materials are required compared to an equivalent single deck on the full width. And, the investment in special equipment is significantly reduced.

Figure 12:
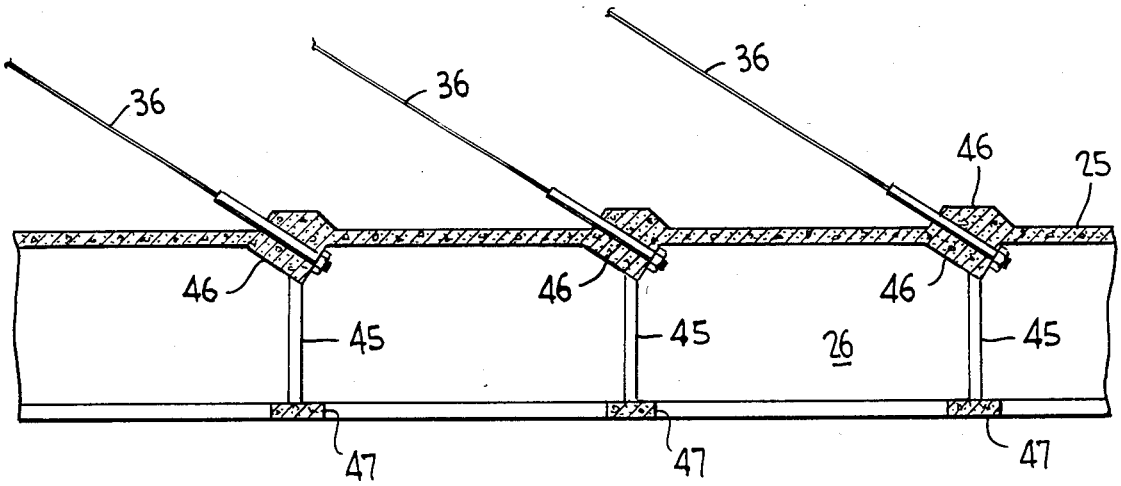
FIG. 12 is a sectional view taken substantially along the line 12—12 of FIG. 11, FIG. 12 being simplified showing only the essential features.

As shown in FIGS. 11 and 12, each delta frame is of precast concrete having an upwardly open, substantially V-shaped central section 45 containing an anchor block 46 to which a free end of the cable stay is anchored in some normal manner. The delta frame has substantially the same depth as central box section 26 of the box girders, and a lower chord 47 thereof extends between box sections 26. Diagonals 48 of the delta frame extend from the upper ends of V-shaped section 45 to the lower chord at its opposite ends, and further diagonal chords 49 are located within box sections 26 and extend from the intersection of chords 47, 48 upwardly and outwardly to an inner corner of the box sections, as clearly shown in FIG. 11.

Obviously, many modifications and variations of the present invention are made possible in the light of the above teachings. It is therefore to be understood that within the scope of the appended claims the invention may be practiced otherwise than as specifically described.

In particular, the swivel crane can be replaced by any suitable handling equipment to place the precast segments on the deck, while the transverse carrying members can be of any other shape than the delta frame shown in the drawings.

Likewise, the bridge structure which is the object of the invention can be cast in place as travelling falsework rather than made of precast segments within the scope of the invention.

What is claimed is:

1. A method of constructing a segmental bridge from like concrete box girders, the bridge having a main span of a predetermined length, and a plurality of interconnected approach spans at opposite ends of said main span, each of said approach spans having a length substantially less than said predetermined length of said main span, and said main span being defined by a pair of longitudinally spaced apart main span piers, said approach spans being defined by pairs of longitudinally spaced apart approach span piers, a last of said approach spans being defined by one of said approach span piers and one of said main span piers, the method comprising the steps of:

(A) first constructing each of said approach spans toward said opposite ends of said main span, said constructing step for each of said approach spans comprising:

(a) extending a pair of transversely spaced apart assembly trusses between one of said pairs of approach span piers which define one of said approach spans, said trusses being movably supported on opposite sides of said one of said pairs;

(b) completely spanning the distance between said one of said pairs by loading precast concrete box girders one-at-a-time on to said trusses from one of said approach span piers which is located a greater distance from said main span compared to the spacing of the other of said approach span piers from said main span, each of said girders having transversely extending wings supported on said spaced trusses;

(c) sliding said box girders in succession in a direction toward said main span, after being loaded on to said trusses, until a first of said girders directly overlies said other approach span pier;

(d) connecting said first box girder to said approach span other pier;

(e) abutting the succeeding girders against said first girder and to each other and connecting all of said girders to one another;

(f) moving said assembly trusses so as to extend between another adjacent pair of said longitudinally spaced approach span piers which define another of said approach spans adjacent said one approach span, one of said another adjacent pair comprising said other approach span pier and the other of said another adjacent pair being spaced closer to said main span compared to said one pier of said another adjacent pair;

(g) repeating said steps (b), (c), (d) and (e) for said another approach span;

(h) repeating said steps (f) and (g) for further adjacent pairs of longitudinally spaced approach span piers defining further adjacent approach spans and for said last approach span at which said main span is reached;

(i) erecting permanent pylons at the locations of said main span piers;

(B) then from said last of said approach spans adjacent said main span, (aa) cantilevering and connecting concrete box girders successively to each other, as a continuation of said last approach span, from said main span piers toward one another until the midpoint between said main span piers is reached; and (bb) during step (aa), supporting said main span from each of said pylons by extending a plurality of permanent cable stays from each of said pylons to designated ones of said girders of each of said last approach spans.

2. The method according to claim 1, wherein said erecting step comprises erecting each of said pylons from segments during said step (bb) by:

(aaa) draping a first of said cable stays over the top of a first pylon segment;

(bbb) placing a second pylon segment over said draped cable;

(ccc) draping a second of said cable stays over said second segments;

(ddd) repeating said steps (aaa) and (bbb) for the remaining cable stays and pylon segments; and (eee) connecting said pylon segments together.

3. The method according to claim 2, wherein said step (C) further comprises providing grooves in the upper ends of said pylon segments for the reception of said draped cables.

4. A method of constructing a two-wide segmental cable stayed bridge from like precast concrete bridge girders of a predetermined depth connected side-to-side and end-to-end, the bridge having a main span of a predetermined length and a plurality of approach spans at opposite ends of said main span, each of said approach spans having a spacing substantially less than said predetermined length of said main span, the method comprising the steps of:

(A) first constructing each of said approach spans toward said opposite ends of said main span, said constructing step for each of said approach spans comprising:

(a) assembling pairs of said girders side-by-side and end-to-end entirely between a first pair of transversely spaced apart piers and a second pair of transversely spaced apart piers longitudinally spaced from said first pair and defining one of said approach spans, said assembling being carried out from said second pair toward said first pair, and said second pair being located closer to said main span compared to the distance of said first pair therefrom;

(b) connecting a first pair of said box girders to each other at adjoining sides and to said second pair of piers;

(c) connecting remaining pairs of said girders to each other at adjoining sides and to adjoining ends of adjacent pairs;

(d) repeating said steps (a), (b) and (c) for further approach spans until said main span is reached, a pair of longitudinally spaced pylons defining said main span;

(B) thereafter, from the last of said approach spans adjacent said main span, constructing said main span by (aa) cantilevering further pairs of precast concrete box girders, similar to said girders employed in step (A), successively to each other, as a continuation of said last approach span, from said pylons toward one another until the midpoint between said pylons is reached;

(bb) connecting said girders of said further pairs respectively to each other at adjoining sides and at adjoining ends of adjacent pairs thereof;

(cc) during steps (aa) and (bb), supporting said main span from each of said pylons by extending a plurality of permanent cable stays from each of said pylons to designated ones of said cantilevered girders and to designated ones of said girders of each of said last approach spans;

(dd) anchoring said cable stays to said designated ones of said girders at respective locations centrally between the connected adjoining sides thereof; and (ee) at only said respective locations, connecting transverse load carrying members of said predetermined depth between said girders side-by-side for providing anchor blocks for said cable stays and for transferring static and dynamic loads of said main span and of said last approach spans to the central plane of support at said cable stays.

5. The method according to claim 4, wherein each of said girders has a central box section with the upper surface thereof forming a bridge deck together with side wing sections extending oppositely therefrom, said connecting step (ee) including providing delta frames as said transverse load carrying members, each of said delta frames comprising a concrete section of substantially the same depth as said central box section and extending between box sections of said connected further pairs.

6. The method according to claim 5, wherein said connecting step (ee) further includes providing a lower chord as part of each said delta frame extending between said box sections, providing a central, upwardly opening, V-shaped section on said lower chord as part of said delta frame and including said anchor block to which an end of one of said cable stays is connected, and providing diagonal chords as part of each said delta frame respectively extending from the upper ends of said V-shaped section to said lower chord at opposite ends thereof.

7. The method according to claim 6, wherein said connecting step (ee) further includes providing further concrete diagonal chords as part of each said delta frame within said box sections, and extending said further diagonal chords outwardly and upwardly from said opposite ends of said lower chord.

8. The method according to claim 4, comprising the further step of (C) erecting each of said pylons from pylon segments during said step (cc) by (aaa) draping a first of said cable stays over the top of a first pylon segment;

(bbb) placing a second pylon segment over said draped cable stay;

(ccc) draping a second of said cable stays over said second segment;

(ddd) repeating said steps (aaa) and (bbb) for the remaining cable stays and pylon segments; and (eee) connecting said pylon segments together.

9. The method according to claim 8, wherein said step (C) further comprises providing grooves in the upper ends of said pylon segments for the reception of said draped cables.

* * * * *